US010898002B1

(12) United States Patent
Sperry

(10) Patent No.: US 10,898,002 B1
(45) Date of Patent: Jan. 26, 2021

(54) SELF-CONTAINED EVENT CHEERING APPARATUS

(71) Applicant: David W Sperry, Ukiah, CA (US)

(72) Inventor: David W Sperry, Ukiah, CA (US)

( * ) Notice: Subject to any disclaimer, the term of this patent is extended or adjusted under 35 U.S.C. 154(b) by 0 days.

(21) Appl. No.: 16/350,488

(22) Filed: Nov. 19, 2018

Related U.S. Application Data

(60) Provisional application No. 62/590,166, filed on Nov. 22, 2017.

(51) Int. Cl.
*A47C 7/72* (2006.01)
*A47C 4/18* (2006.01)
*H04R 5/02* (2006.01)

(52) U.S. Cl.
CPC ..... *A47C 7/727* (2018.08); *A47C 4/18* (2013.01); *H04R 5/023* (2013.01)

(58) Field of Classification Search
CPC ..... A47C 7/727; A47C 7/72; A47C 7/54
USPC ..... 297/35–45
See application file for complete search history.

(56) References Cited

U.S. PATENT DOCUMENTS 5,490,711 A * 2/1996 Pollock ..... A47C 7/72 297/186
5,688,023 A * 11/1997 Blocker, Jr. ..... A47C 7/62 297/188.03
5,926,864 A * 7/1999 Lynch ..... A47K 11/04 4/483
6,523,894 B1 * 2/2003 Mellace ..... A47C 1/14 297/16.1
6,935,755 B2 * 8/2005 Soper ..... A47C 7/72 353/122
8,795,015 B1 * 8/2014 Nguyen ..... B63B 34/50 441/129
8,864,221 B1 * 10/2014 Delvilla ..... A47C 7/62 297/180.11
9,286,875 B1 * 3/2016 Kerr ..... G10D 13/02
9,603,457 B2 * 3/2017 Massaud ..... A47C 7/725
10,463,157 B1 * 11/2019 Liniado ..... A47C 4/04
2001/0026087 A1 * 10/2001 Tomita ..... A47C 7/72 297/217.4
2003/0135294 A1 * 7/2003 Lam ..... G06F 8/30 700/94
2008/0100107 A1 * 5/2008 Paslawski ..... A47C 4/286 297/217.4
2012/0223555 A1 * 9/2012 Brown, Jr. ..... A47C 7/72 297/217.4
2017/0202357 A1 * 7/2017 Holzner ..... A47C 7/72
2018/0041354 A1 * 2/2018 Nelson ..... A47C 7/72
2018/0063613 A1 * 3/2018 Cohen ..... H04R 1/028

* cited by examiner

*Primary Examiner* — David R Dunn
*Assistant Examiner* — Tania Abraham
(74) *Attorney, Agent, or Firm* — Savantek Patent Services; Ivan E. Rozek

(57) ABSTRACT

A portable lightweight cheering apparatus integrated with a collapsible tubular frame chair. The apparatus comprises sound recordings, electronic equipment to store the sound recordings, and devices to convert the recordings to sounds reproduced by built-in speakers A push of any one of momentary pushbutton switches disposed on the chair arm-rest sides will cause a recording sound to emanate from the speakers; a tap on any one of momentary pad switches will cause a recorded drum sound to emanate from the speakers enabling a user to be a virtual drummer and a virtual cheering group.

6 Claims, 9 Drawing Sheets

SELF-CONTAINED EVENT CHEERING APPARATUS

CROSS REFERENCE TO RELATED APPLICATIONS

This application is based on provisional application Ser. No. 62/590,166, filed on Nov. 22, 2017.

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of portable folding chairs and more specifically to a lightweight folding chair with built in audio devices. Sporting event spectators commonly bring along accessories to improve their experience. One common accessory for spectators may be their own seating. Spectators bring their own seats due to sports often being played in parks with limited seating or for tailgating outside the venue. Another common accessory for sporting events may be a music system. When considering which specific accessories to bring to an event, portability is a factor since they may be transported in limited car space and may need to be carried along with various other accessories.

Chairs with built in speakers are known, for example Steven G. Linder's U.S. Pat. No. 6,135,551 titled "INFLATABLE CHAIR WITH SPEAKERS" Another chair having the ability to create drum sounds is found in U.S. Pat. No. 9,286,875B1, an electronic percussion instrument.

However, this invention provides advantages over the prior technology. The U.S. Pat. No. 9,286,875 patent includes a chair that is not portable and has drum sound switches along the entire arm, which would make it problematic for a person to rest his or her arm without accidentally setting off a drum sound. In addition, the patent shows the amplifier and speakers being outside of the chair structure, meaning that they would have to be carried separately if one were to attempt to take the chair to a sporting event.

BRIEF SUMMARY OF THE INVENTION

The primary object of the invention is to provide a folding chair that can be collapsed into an essentially flat position for carrying and transportation and opened into a sitting position for sporting events, especially for outdoor youth sporting events, wherein the chair includes built-in audio devices.

Another object of the invention is a folding chair including built in audio devices to amplify and broadcast sounds that are activated by a plurality of switches mounted on the armrests of the chair.

A further object of the invention is a collapsible folding chair including built in audio devices where the switches activate a processing unit that includes stored drum sounds, cheering sounds and other sounds suitable for being made at sporting events.

Yet another object of the invention is a folding chair including built in audio devices where a wireless speaker is built into an armrest of the chair which can play music generated from a smart phone or other wireless equipped audio transmitting device.

Still yet another object of the invention is a folding chair including built in audio devices where a rectangular towel member can be removably attached to the backrest portion of the chair.

Another object of the invention is to include the printing of sports team logos either on the cloth portions of the chair or on the towel member that can be attached to the chair.

Other objects and advantages of the present invention will become apparent from the following descriptions, taken in connection with the accompanying drawings, wherein, by way of illustration and example, an embodiment of the present invention is disclosed.

In accordance with the detailed description of the invention, there is disclosed a lightweight collapsible folding chair with built-in audio devices comprising: a standard folding chair frame and cloth support panels, a left armrest member, a right armrest member, a left and right amplifier circuit, a left and right processor unit, a left and right front speaker, a plurality of momentary switches, a left and right battery power supply, a wireless speaker, the left and right armrests being primarily mirror images of each other, each armrest consisting of a top panel, a front speaker hole panel, elongate left and right side panels, a rear upwardly extending wireless speaker housing and an under panel, the under panel including a speaker holding enclosure, a battery compartment and a processor unit enclosures, the processor unit including the digitally encoded recordings of a plurality of audio sounds including drum sounds, cheering sounds, air horn sounds, and siren sounds, the momentary switches mounted on the forward top and side portions of each armrest member, each momentary switch controlling the transformation of one audio sound into analog signals reproduced by the speakers, some momentary switches being flat panels that when struck by the user's fingers can produce drum sounds, and the wireless speaker is mounted within the rear upwardly extending wireless speaker housing.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION

Figure 1:
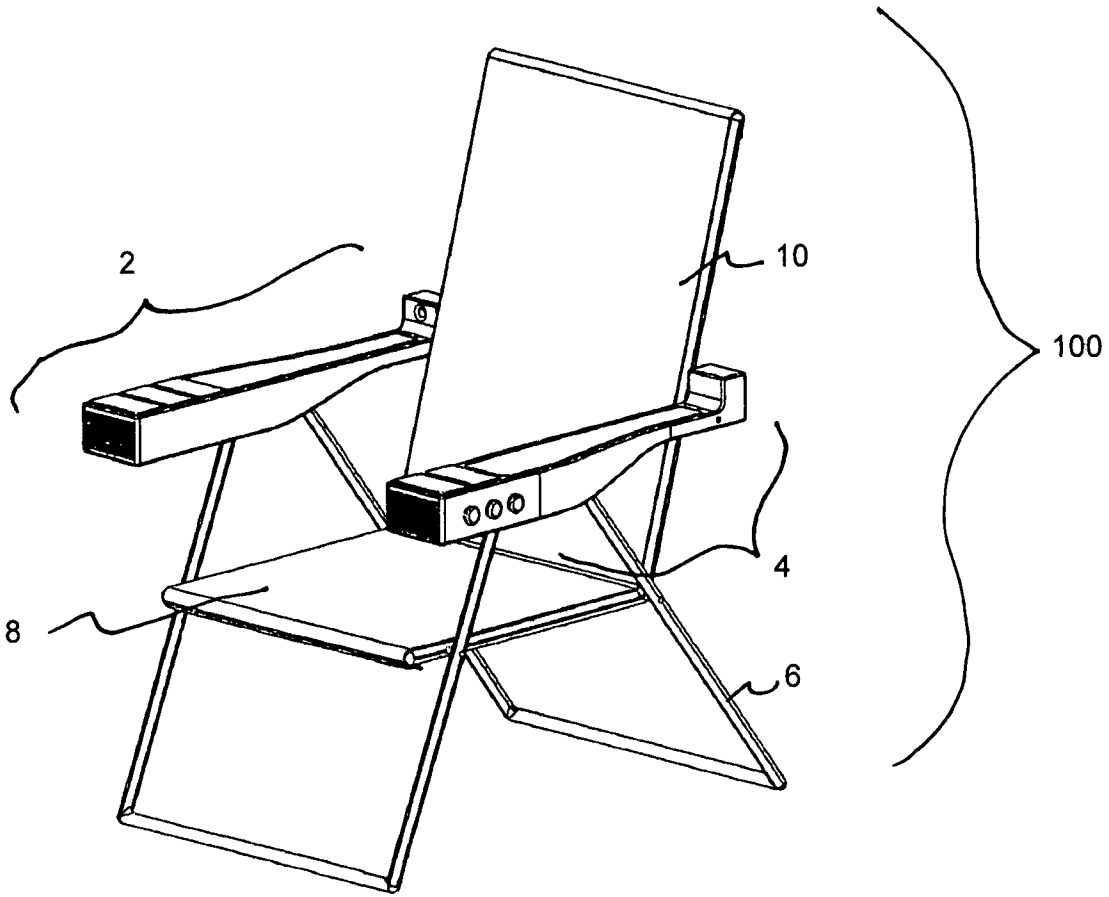
FIG. 1 is a front perspective view of the invention embodiment.

Detailed descriptions are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. Referring now to FIG. 1 we see a front perspective view of the embodiment 100. A relatively standard folding outdoor lounge chair includes a fabric back support 10, a fabric seat support 8 supported by a tubular metal frame 6. The unique aspects of this chair are the left and right armrests 2, 4 which contain various audio features which will be fully described below. The armrests 2, 4 are essentially mirror images of each other.

Figure 2:
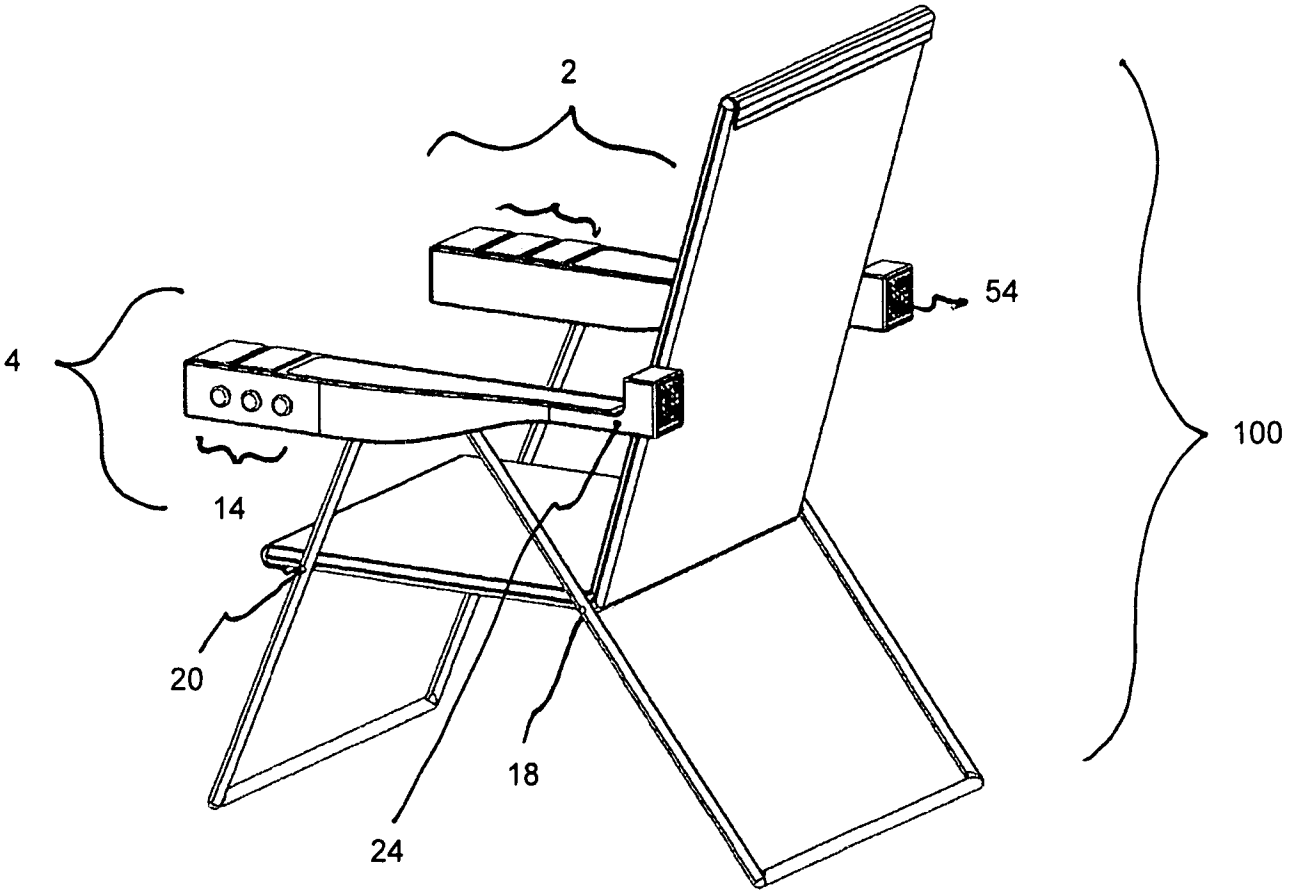
FIG. 2 is a rear perspective view of the invention embodiment.

FIG. 2 is a rear perspective view of the embodiment 100. The chair portion can fold flat by the seat and back pivoting about pins 20, 24, 18 as is well known in the construction of portable outdoor lounge chairs. The frame can be made from lightweight aluminum tubing or from steel tubing. Each 2, 4 includes a plurality of flat momentary flat switch pads 12 and a plurality of push button momentary switches 14. The flat momentary flat switch pads 12 allow the user to tap the momentary flat switch pad 12 with his or her fingers to produce electronically simulated or recorded drum sounds. Rear speaker grill panel 54 allows sound to emanate from a wireless enabled speaker located within the rear portion of the housing 2.

Figure 3:
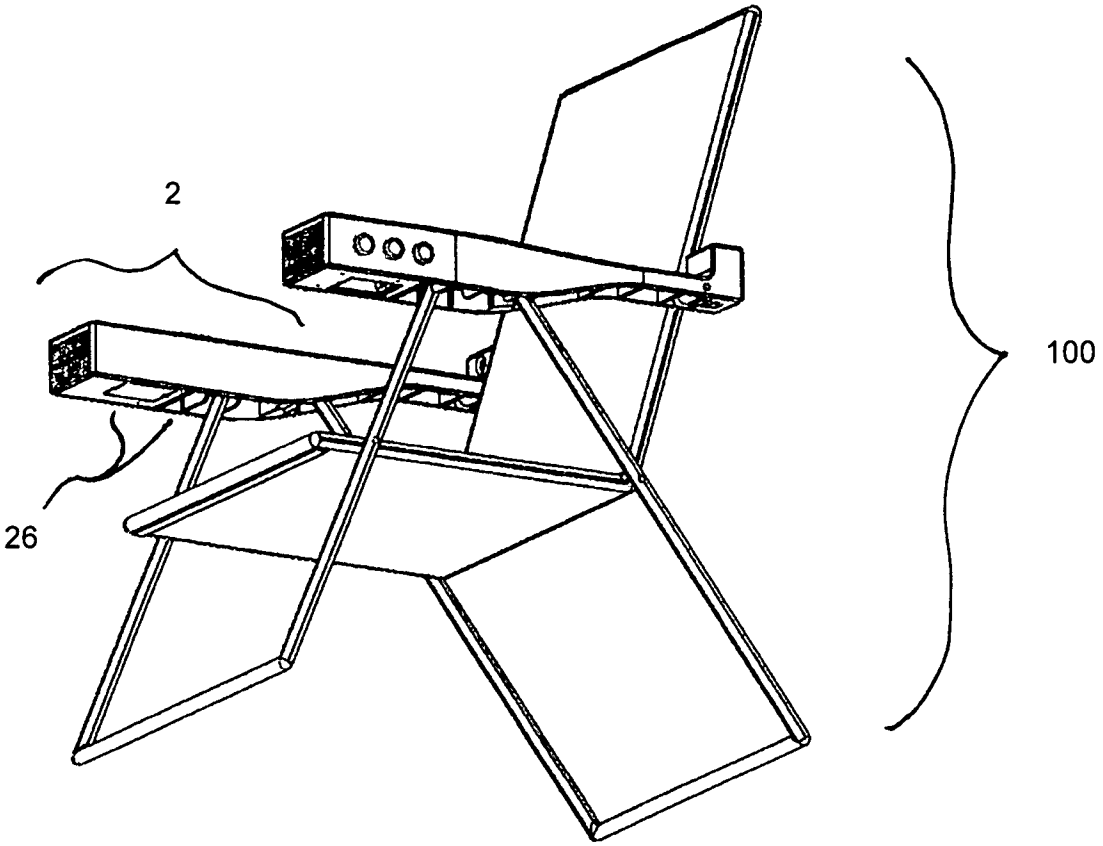
FIG. 3 is an underside perspective view of the invention embodiment.

FIG. 3 is a perspective view of the underside of the embodiment 100 showing that the armrest members 2, 4 are relatively hollow underneath 26.

Figure 4:
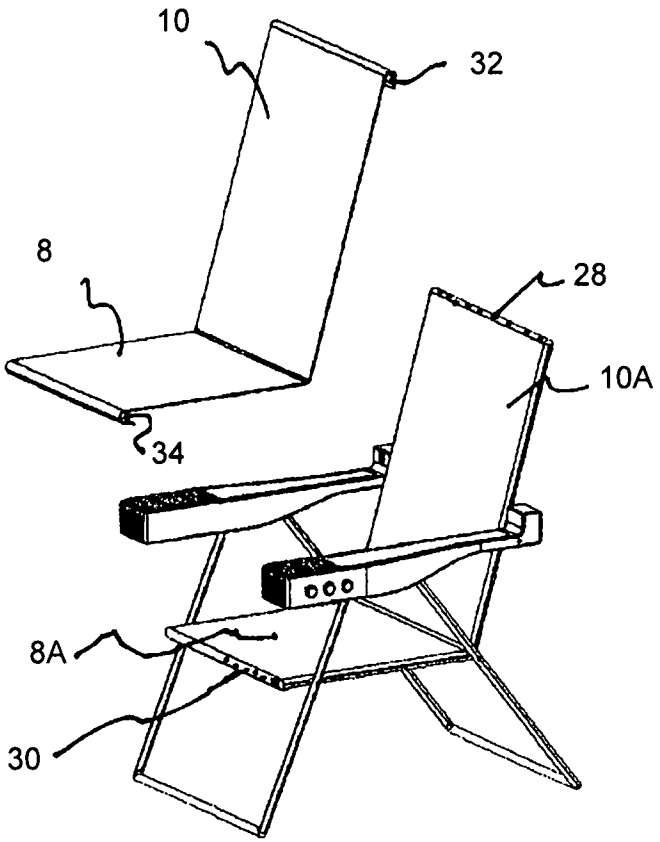
FIG. 4 is an exploded view of the removable towel portion of the invention embodiment

FIG. 4 is an exploded view showing a rectangular towel 10,8 that can be removably attached to the chair back 10A and seat 8A via loop fasteners 28, 30 and hook fasteners 32, 34. Alternately, the towel can be shorter, 10, so that it only covers the back 10A of the chair. The towel or the seat back can be printed with a team's logo so that it will be customized to specific sports teams.

Figure 5:
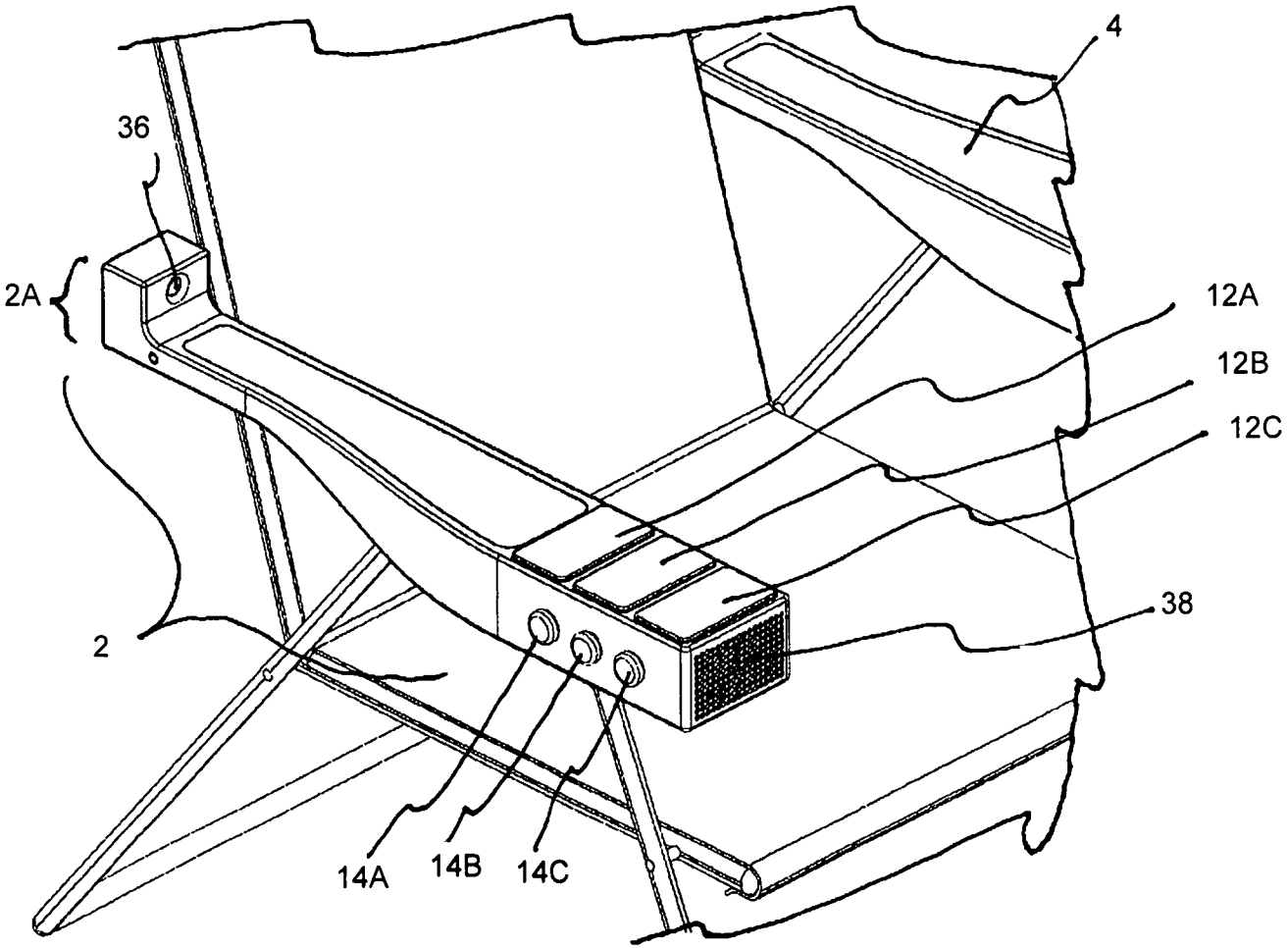
FIG. 5 is a partial perspective view of the armrest of the invention embodiment.

FIG. 5 is a partial perspective view which highlights left 2. The includes three momentary flat switch pads 12A, 12B, 120, that act as drum pads, so that when a person taps on the pads, each pad activates a drum sound. Two additional momentary flat switch pads on 4 provide additional drum sounds. the sounds include a snare drum sound, hi hat sound, crash cymbal sound and tom tom sound. The front panel 38 includes apertures that let sound emanate from a speaker 46 located within the front of the housing 2. Switches 14A, 148, 14C, are momentary push button switches that, when pressed, cause other sounds to be broadcast, including a cheering sound, a siren sound and an air horn sound. The right armrest 4 also includes drum momentary flat switch pads and push button switches which cause additional unique sounds to be broadcast. The rear portion 2A of 2 includes an upwardly raised hollow portion that can house a wireless speaker which can be turned on by pressing switch 36. The speaker 52, shown in FIG. 9, points rearward and is enclosed by perforated panel 54. The wireless speaker 52 allows a user to play music from his or her smart phone or other wireless device, and for the user to drum to the music using drum pads 12A, 128, 12C. on 2 as well as the two additional drum pads on 4.

Figure 6:
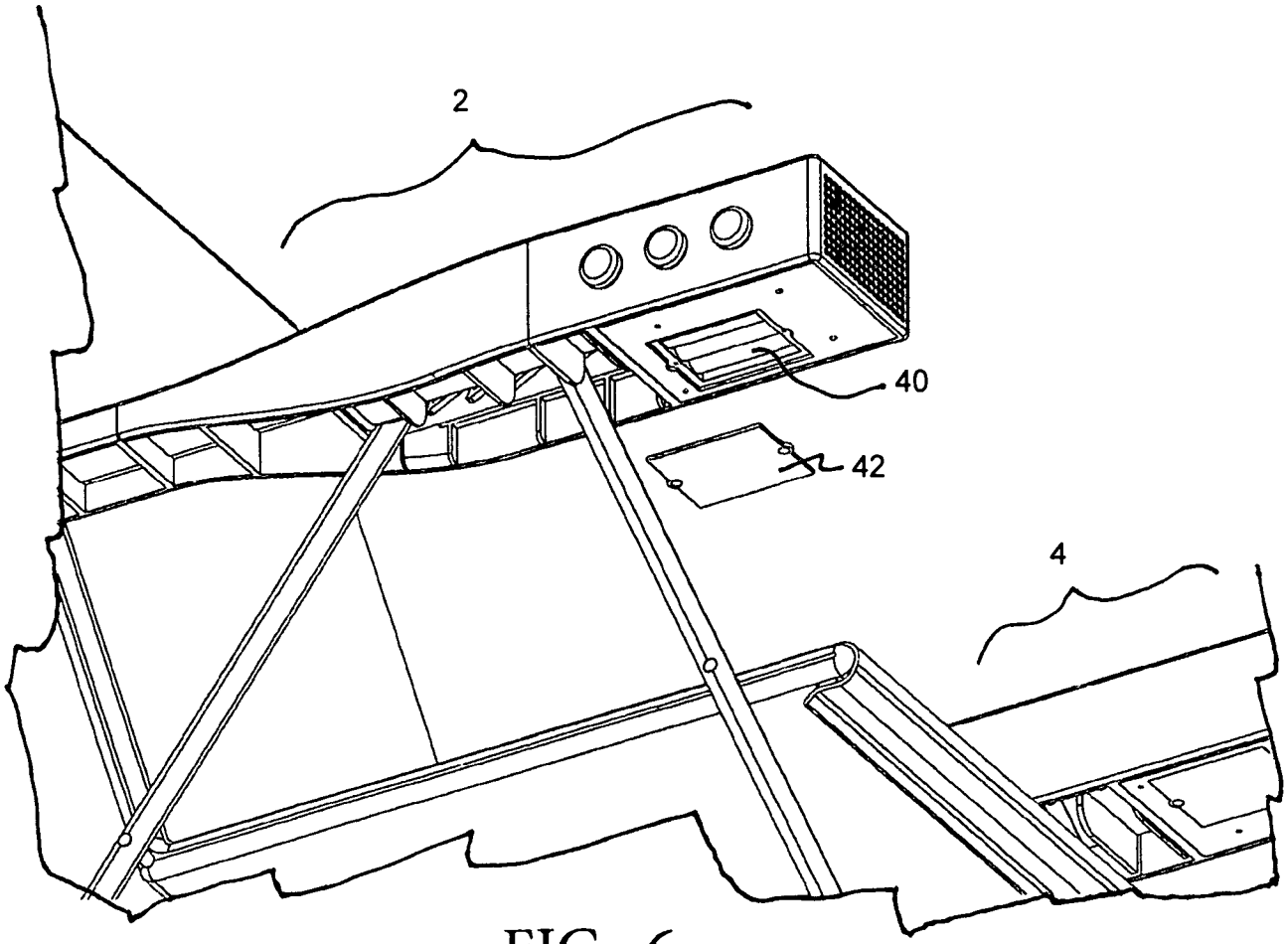
FIG. 6 is an underside view of the armrest of the invention embodiment.

FIG. 6 is an under view of arm 2 showing removable battery door 42. In the present version, the amplifiers and speakers are powered by four removable and replaceable AA batteries, however, the they may also be powered by rechargeable batteries or battery. Each arm 2, 4 has its own battery power supply, speaker and amplifier. This configuration allows each arm to be independent so that it is not necessary to run electrical cable from one arm to the other.

Figure 7:
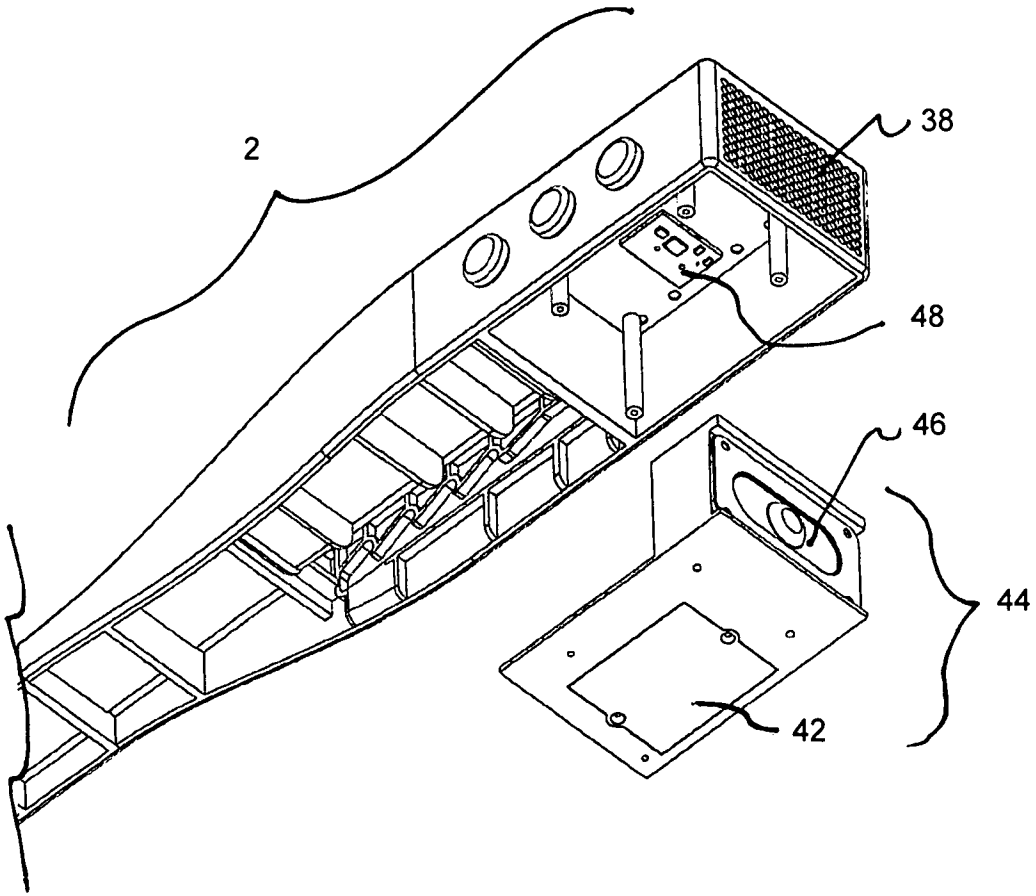
FIG. 7 is an exploded view of the under arm portion of the invention embodiment

FIG. 7 is an under view of 2 showing the speaker compartment assembly 44 removed from the underside of armrest 2. A microprocessor 48 and associated electronic components is mounted on the underside of the forward portion of the 2. The speaker compartment assembly 44 is bolted to the underside of armrest 2 thereby enclosing al electronic components including speaker 46 and AA batteries located behind removable battery door 42. This configuration is relatively water resistant so that the invention 100 can be used during inclement weather.

Figure 8:
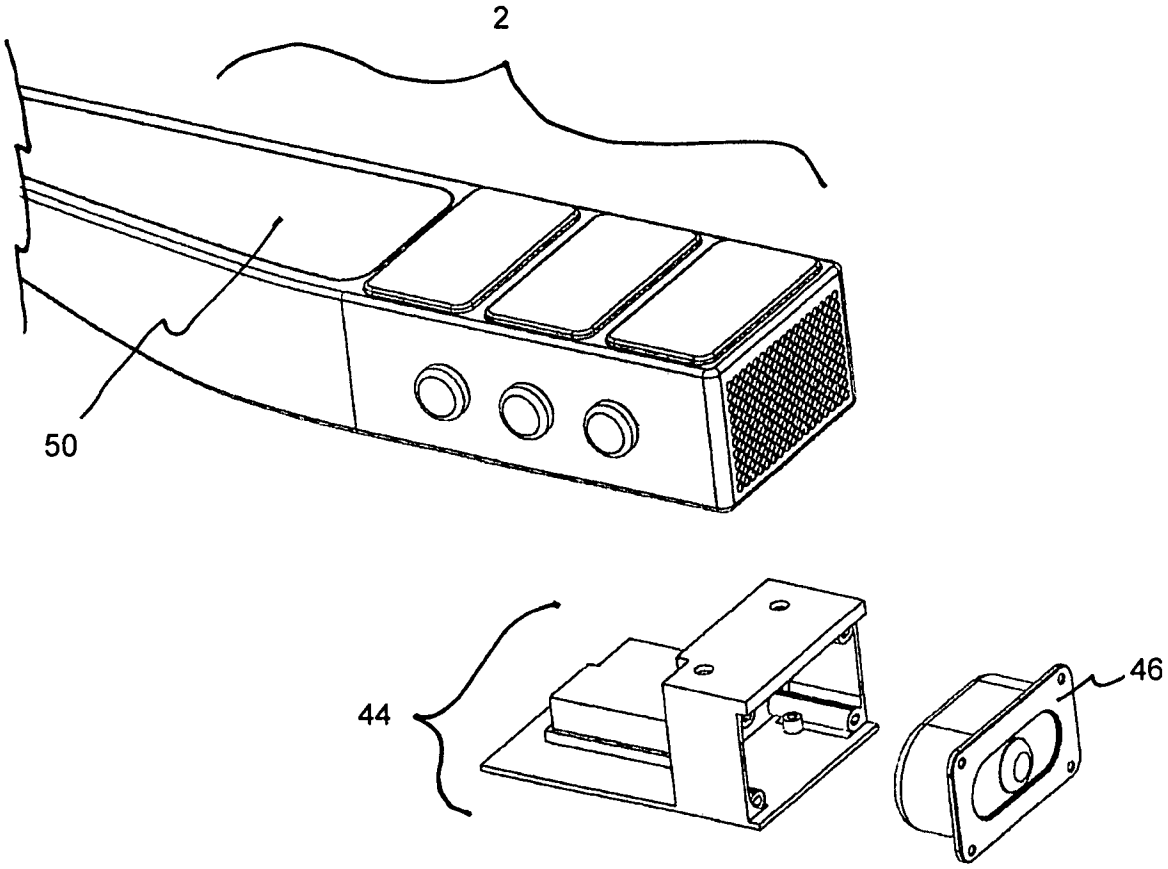
FIG. 8 is an exploded view of the speaker holding portion of the invention embodiment.

FIG. 8 shows how speaker 46 slides into the cavity of speaker compartment assembly 44.

Figure 9:
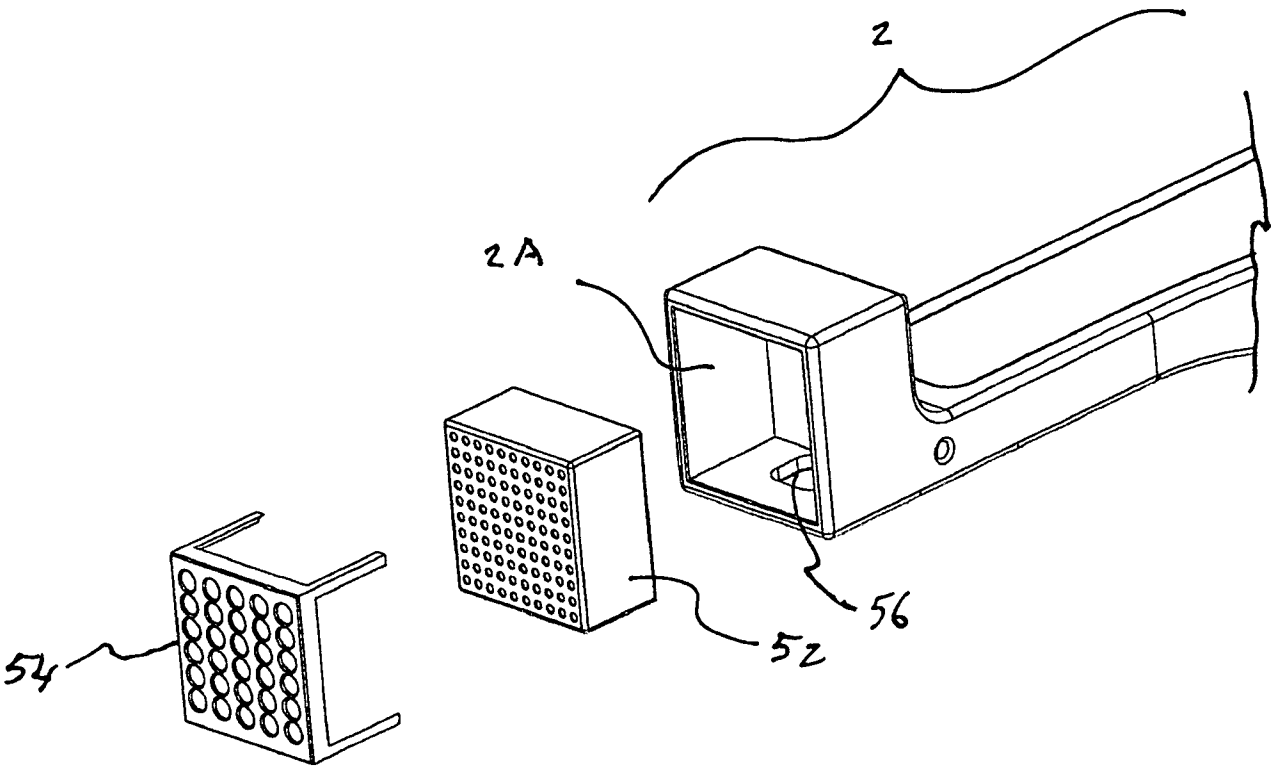
FIG. 9 is an exploded view showing a wireless speaker being installed into an armrest of the chair.

FIG. 9 is an exploded view showing wireless speaker 52 about to be installed into housing 2A and covered by speaker panel 54. The aperture 56 allows a user to have access to the recharging port located on the underside of the wireless speaker 52.

The entire embodiment 100 allows a person to easily transport the chair to a sporting event and to easily broadcast a variety of sounds to the neighboring participants that will increase the fun level at any sporting event. Obviously, the embodiment 100 can be used for other occasions such as house parties and can also be used by an individual just for the fun of creating drum sounds along with one's favorite music. The totally self-contained, water resistant design makes the invention simple to set up in a wide variety of environments. The optional custom printed towel covers further add to team spirit on game day.

While the invention has been described in connection with an embodiment above, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A self-contained event cheering apparatus comprising:

a lightweight collapsible folding chair, wherein the lightweight collapsible folding chair comprises:

a lightweight tubular frame movable between an essentially flat configuration and a sitting configuration;

a left armrest and a right armrest;

a plurality of electronic devices comprising a storage of digitally encoded sound recordings, wherein the digitally encoded sound recordings comprise a plurality of cheering sounds and a plurality of drum sounds;

an electronic system transforming the digitally encoded sound recordings into analog signals;

a plurality of sound output devices converting the analog signals into sounds, wherein the plurality of sound output devices comprises speakers hard-wired to the electronic system transforming the digitally encoded sound recordings into analog signals and speakers wirelessly connected to the electronic system transforming the digitally encoded sound recordings into analog signals;

the left armrest and the right armrest of the lightweight collapsible folding chair being essentially mirror images of each other, wherein each armrest comprises a top panel and an outside elongate panel;

the left armrest top panel and the right armrest top panel each further comprising a plurality of flat momentary switch pads and wherein the left armrest outside elongate panel and the right armrest outside elongate panel each comprises a plurality of momentary pushbutton switches;

wherein each flat momentary switch pad when closed will cause one of the plurality of drum sounds to emanate from the plurality of the sound output devices; and wherein each momentary pushbutton switch when closed will cause one of the cheering sounds to emanate from the plurality of the sound output devices.

2. The self-contained event cheering apparatus of claim 1, wherein the left armrest and the right armrest each further comprises an underside, wherein a plurality of storage spaces disposed on the underside of the left armrest and on the underside of the right armrest house the storage of digitally encoded sound recordings, and the electronic system transforming the digitally encoded sound recordings into analog signals, and house the plurality of the sound output devices.

3. The self-contained event cheering apparatus of claim 1, wherein the electronic system transforming the digitally encoded sound recordings into analog signals further comprises a custom processor programmed to connect one of the plurality of flat momentary switch pads to one of the plurality of drum sounds and to connect one of the plurality of the momentary pushbutton switches to one of the plurality of cheering sounds.

4. The self-contained event cheering apparatus of claim 1, wherein the plurality of cheering sounds comprises sounds of cheering humans, air horn sounds and siren sounds.

5. The self-contained event cheering apparatus of claim 1, wherein plurality of drum sounds comprises generic drum sounds, sounds of snare drum, hi hat sound, crash cymbal sound and tom-tom sound.

6. The self-contained event cheering apparatus of claim 1, wherein the lightweight collapsible folding chair further comprises a seating surface and a backrest surface, wherein material of the seating surface and material of the backrest surface are selected from a group consisting of: cloth and woven ribbons, woven ribbons, flexible tubes, leather and formed rigid plastic, wherein the backrest surface may be imprinted with a graphic design, a logo or an advertisement.

* * * * *